US011958514B2

(12) United States Patent
Pertosa

(10) Patent No.: US 11,958,514 B2
(45) Date of Patent: Apr. 16, 2024

(54) DEVICE AND METHOD FOR DETECTING RAILWAY EQUIPMENT DEFECTS

(71) Applicant: MER MEC S.p.A., Monopoli (IT)

(72) Inventor: Vito Pertosa, Monopoli (IT)

(73) Assignee: MER MEC S. P. A., Monopoli (IT)

( * ) Notice: Subject to any disclaimer, the term of this patent is extended or adjusted under 35 U.S.C. 154(b) by 447 days.

(21) Appl. No.: 17/274,169

(22) PCT Filed: Sep. 2, 2019

(86) PCT No.: PCT/IB2019/057378
§ 371 (c)(1),
(2) Date: Mar. 6, 2021

(87) PCT Pub. No.: WO2020/053699
PCT Pub. Date: Mar. 19, 2020

(65) Prior Publication Data

US 2021/0403060 A1 Dec. 30, 2021

(30) Foreign Application Priority Data

Sep. 10, 2018 (IT) ..... 102018000008445

(51) Int. Cl.
*B61L 23/04* (2006.01)
*B61L 25/02* (2006.01)

(52) U.S. Cl.
CPC ..... *B61L 23/044* (2013.01); *B61L 25/025* (2013.01); *B61L 25/026* (2013.01)

(58) Field of Classification Search
CPC .... B61L 23/044; B61L 25/025; B61L 25/026; B61L 23/042; B61L 23/04
See application file for complete search history.

(56) References Cited

U.S. PATENT DOCUMENTS 5,867,404 A * 2/1999 Bryan ..... B61L 23/048 714/724
9,764,746 B2 * 9/2017 Bhattacharjya ..... B61L 23/042
2004/0263624 A1 * 12/2004 Nejikovsky ..... B61L 23/042 348/148

(Continued)

FOREIGN PATENT DOCUMENTS

DE 19801311 A1 * 5/1999 ..... B60M 1/28
KR 20110058401 A * 6/2011

*Primary Examiner* — Robert J Hance
(74) *Attorney, Agent, or Firm* — R. Ruschena Patent Agent, LLC

(57) ABSTRACT

A device for detecting railway equipment defects, comprising at least three diagnostic modules mounted on a generic railway vehicle:

- a first module (geometrical module) configured to measure at least a geometrical feature of the track;
- a second module (acceleration module) configured to measure in at least a point of said vehicle the side and/or vertical accelerations transmitted from the track to said vehicle;
- a third module (visual module) configured to acquire the images of the track elements and to analyze them to verify the presence of anomalies;

said modules being configured to associate with each detection carried out when the railway vehicle passes, on which they are mounted, the position where the detection was carried out and to calculate, for each detection, a severity index representative of the deviation of the detection with respect to the standard condition without defects.

7 Claims, 1 Drawing Sheet

(56) References Cited

U.S. PATENT DOCUMENTS

| | | | | |
|---|---|---|---|---|
| 2007/0217670 | A1* | 9/2007 | Bar-Am | B61L 23/047 382/141 |
| 2010/0004804 | A1* | 1/2010 | Anderson | B61K 9/08 701/19 |
| 2012/0300060 | A1* | 11/2012 | Farritor | B61K 9/08 348/125 |
| 2013/0231873 | A1* | 9/2013 | Fraser | B61K 5/00 702/35 |
| 2014/0200830 | A1* | 7/2014 | Bhattacharjya | B61L 23/045 702/34 |
| 2014/0277824 | A1* | 9/2014 | Kernwein | B61K 9/08 701/1 |
| 2020/0047780 | A1* | 2/2020 | Marichal | B61L 23/045 |

* cited by examiner

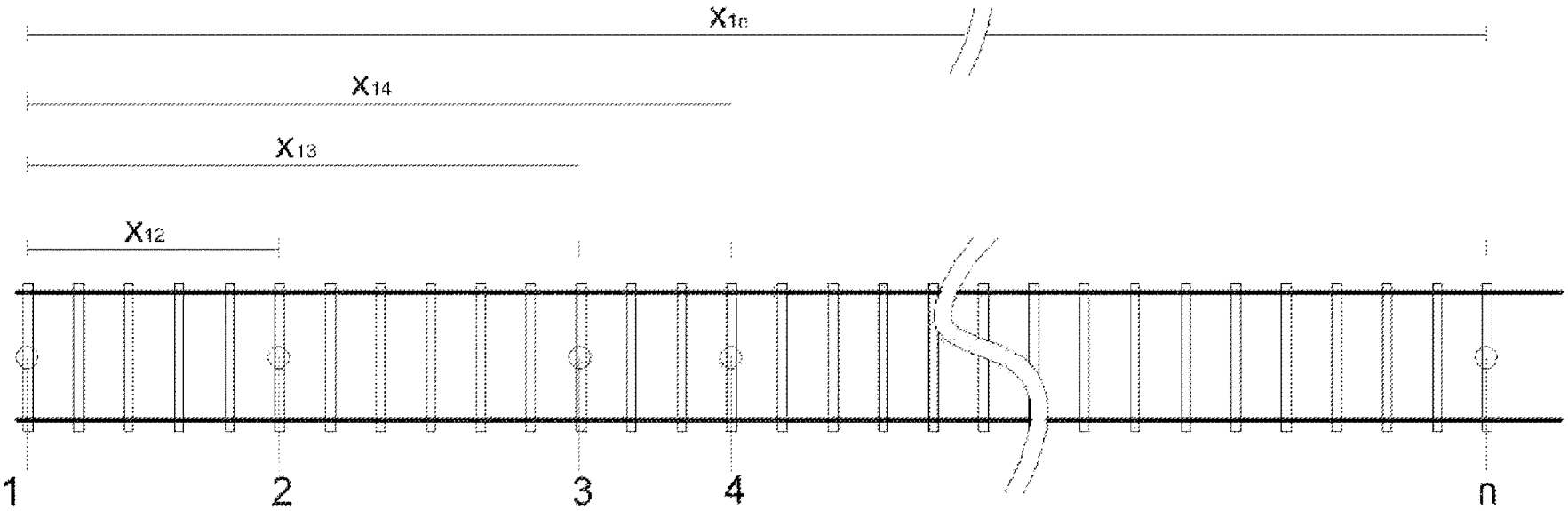
X16
X14
X13
X12
1
2
3
4
n

DEVICE AND METHOD FOR DETECTING RAILWAY EQUIPMENT DEFECTS

BACKGROUND OF THE INVENTION

1. Field of the Invention

Object of the present invention is a device and method for detecting railway equipment defects.

2. Brief Description of the Prior Art

As it is known, railway equipment comprises tracks, any kind of railroad switches, ballast and anything needed for mounting, fixing and adjusting the railroad over which trains pass. It is also known that railway equipment defects represent a danger for circulating trains, since they can cause running instability and derailment in the worst cases.

The severity of a defect is linked to the capacity of the same defect to cause in the vehicle anomalous vertical and transversal accelerations which can lead to the vehicle derailment.

The defects which can transmit anomalous accelerations to a railway vehicle are for example track geometrical defects detected for parameters as track twist, alignment, longitudinal level.

Other defects are cracks on sleepers, coupling tools anomalies, anomalies of joints (including the isolated, glued ones), insufficient crushed stone for ballast, absence or loosening of sleeper screws for sleepers and track bolts for joints.

Therefore, it is particularly important to detect defects and to evaluate their severity, i.e. the probability they cause a derailment.

In order to detect railway equipment defects there have been realized and are known at the state of the art a plurality of measuring and control systems which, mounted on railway vehicles, allow to detect the just described railway equipment defects.

Moreover, the causes of the just described defects can be various and so, individuating a defect is not enough to individuate univocally its cause. As a way of example, geometrical defects can be caused by: ballast yielding, isolated joints yielding, sleepers braking, deterioration or absence of coupling tools between rail and sleeper.

It is clear that it is possible to plan a correct maintenance operation only knowing the defect cause. Therefore, another problem, strictly linked to the defect detection and severity evaluation is the individuation of their causes, so that they can be removed by suitable maintenance operations and they are prevented from occurring again.

As all the measuring systems, also the railway diagnostics systems suffer from errors and so from false positives, which mean that a severe defect is detected when instead it is absent, or it is not so severe. It is to be specified that, according to what known at the state of the art, the defect severity index is evaluated as a function of the comparison between the values of the critical parameters monitored by the diagnostic systems and the relative critical thresholds which can define one or more severity indexes.

However, this conceptually simple enough approach has some limits. In primis, the comparison of a parameter value with a threshold value does not allow to consider the synergic effect of a plurality of defects, also of different kind, localized close to each other: even if the presence of a single defect characterized by a parameter, whose value is under the relative threshold, guarantees the vehicle running safety, the concomitance of more close defects can increase dangerously the whole severity index for running trains, even if the severity index of the single defects is kept under the threshold value.

In some cases, this consideration leads to use in the systems known at the state of the art very preventive threshold values, while in other cases the synergic effect of more defects is simply not considered, thus creating a danger condition for the train circulation.

Therefore, the percentage of false positives with respect to real defects is often high and economically unacceptable, since it compels operators to further work to verify the detected defects or not.

Moreover, it is just for this approach aiming at the individuation of the single defect that the diagnostic systems known at the state of the art are limited to defects detection and measurement, without automatically determining their cause.

A first example of device known at the state of the art is described in DE19801311, where it is described a railway maintenance vehicle comprising a plurality of diagnostic modules arranged in various parts of the vehicle, in which various features of the railway equipment are analyzed in order to evaluate their influence on a defect of the railway equipment. DE19801311 suggests comparing each measured variable with a respective predetermined threshold. Moreover, it is indicated to normalize the position of each acquisition of parameters carried out by each diagnostic tool with respect to the center of the vehicle, so that maintenance per kilometer reports can be made.

In the system described in DE19801311 the provision of many sensors allows to determine a cause-effect relation between various close defects: for example a defect on the overhead cable can be generated by a geometrical defect of the track which generates an anomalous attitude of the vehicle, and so, of the pantograph which then wears out the overhead cable anomalously. So, DE19801311 suggest investigating the cause-effect relation between different kinds of defects, to help the maintenance operator to carry out the correct maintenance operation.

In DE19801311, instead, there is no reference to the synergic effect which many close defects, also moderate if considered singularly, can exert on the circulation safety. In fact, the threshold each defect is to be compared with is predetermined and does not depend on the presence or absence of other close defects of any kind.

Another example is described in US2007/217670, where it is described a railway vehicle provided with a video acquisition system configured to record the track when the train passes and which is provided with an image processing software configured to detect the irregularities and to compare each irregularity with the defects predefined in the defect benchmark library. If the irregularity is equal or exceeds a safety threshold, the image is assigned a code of the defect kind. The image of the irregularity is then transmitted to be analyzed by a track expert. Also in this case, regardless of many acquisition devices are provided on board of the vehicle or not, there are no indications of the fact that data deriving from the various acquisitions are used to eliminate the false positives derived from each acquisition or to evaluate the severity of each defect in its context (i.e. more or less close to other defects). Yet, another example is described in EP33333043, in which it is described a detection method in which with each defect is associated a severity index calculated by assigning weights to the different features of the same defect: for example, defect length, position on head and shank of the rail, transit frequency on that point. So, also in this case, the severity index does not calculate the synergic effect on the vehicle dynamics of many close defects.

Technical Problem

As it can be noted, in all the cited embodiments, the railway vehicles are provided with a plurality of diagnostic tools, but the severity of each defect is evaluated singularly, by comparison it with a safety threshold. At the most, it is investigated the cause-effect relation between many defects occurred in the same point.

However, this approach has a series of limits: in primis, if the safety threshold, which is fixed for each defect, is very high, potentially dangerous defects can be ignored, while if to obviate this problem the safety threshold is lowered, "false positives" can be detected, i.e. anomalies taken for defects; in secundis, the same fact to fix a predetermined safety threshold with which to compare the acquired parameters for each defect leads to the impossibility to evaluate, when deciding the defect severity, its position with respect to the other defects (whether of the same kind or not).

Therefore, there remains unsolved the problem to provide a device which can be mounted on railway vehicles and a method for analyzing the data detected by such device, which allow to detect the defects of the equipment, thus exceeding the embodiments known at the state of the art.

In particular, it is unsolved the problem to provide an analysis method of data detected by a plurality of diagnostic devices of the railway equipment, mounted on board of the vehicle, which uses the acquired data in order to avoid the detection of false positives, as well as in order to evaluate the synergic effect on circulation safety due to consecutive defects.

SUMMARY OF THE INVENTION

Aim of the present invention is to provide a device which can be mounted on railway vehicles configured so that it is possible to detect at the same time and automatically a plurality of different kinds of possible defects of the railway equipment and their severity index, and a method for analyzing data measured by means of such device which allows to obtain more accurate evaluations of the defects severity than the ones possible by using the systems known at the state of the art. According to another aim, the object of the present invention provides a device and a method which allow both to reduce the quantity of false positives detected and to consider the synergic effect of moderate defects.

Yet, another aim of the present invention is to provide a device and a method for analyzing data which allow to associate with the defects detected the cause of the same and to plan consequently the correct maintenance operation.

The invention realizes the prefixed aims since it is a device for detecting railway equipment defects, comprising at least three diagnostic modules mounted on a generic railway vehicle:

- a first module (geometrical module) configured to measure at least a geometrical feature of the track;
- a second module (acceleration module) configured to measure in at least a point of said vehicle the side and/or vertical accelerations transmitted from the track to said vehicle;
- a third module (visual module) configured to acquire the images of the track elements and to analyze them to verify the presence of anomalies;

said modules being configured to associate with each detection carried out when the railway vehicle passes, on which they are mounted, the position where the detection was carried out and to calculate, for each detection, a severity index representative of the deviation of the detection with respect to the standard condition without defects.

BRIEF DESCRIPTION OF THE DRAWINGS

In FIG. 1 a schematic view of a railway is shown, with the position of the detected defects(1, 2, 3, 4, n) and their distances from the first detected defect (x12, x13, x14, x1n).

DETAILED DESCRIPTION OF THE INVENTION

According to a preferred embodiment, the system according to the present invention comprises at least three diagnostic modules mounted on a generic railway vehicle:

- a first module, called geometrical module, dedicated to measuring track geometrical parameters (rail gauge, superelevation, alignment, longitudinal level, track twist or any other parameter derived from geometrical measures on track);
- a second module, called acceleration module, dedicated to measuring side and vertical accelerations transmitted from track to measuring vehicle;
- a third module, called visual module, configured to acquire images of the track elements and to analyze them automatically to detect visual defects, for example absence or anomalies of couplings, joints anomalies, insufficient quantity of crushed stones, absence or loosening of sleeper screws for sleepers and track bolts for joints.

The three modules are configured to associate with each detection of a potential defect carried out when the railway vehicle passes, on which they are mounted, the position where such detection was carried out. This association can be carried out by means of a GPS signal and/or an odometer.

The three modules are also configured to calculate, for each detection, an index representative of the deviation of the detection with respect to the standard condition without defects, in the following also called severity index ($h_i$).

The diagnostic method for detecting railway equipment defects which can be applied with the device according to the present invention comprises the following steps of:

a) measuring geometrical, accelerometric and visual parameters at the same time, by means of the just described three diagnostic modules;
b) evaluation of the severity index calculated for all the detections, in order to detect potential defects, by associating with each potential defect the position where it was detected;
c) comparison of said severity index with at least a predetermined critical threshold for defect kind.

The method is characterized in that it further comprises:

e) another analysis for
(i) verifying the detected defect, thus excluding that it is a false positive;
(ii) determining the cause of the defect;
(iii) verifying if a defect, even if the severity index is lower than the threshold of step d), is to be considered dangerous since it is close to other defects.

As a function of the results of the analysis of point e), therefore, it is possible to determine the kind of maintenance to be carried out to restore the normal conditions of the equipment in a more efficient and exact way with respect to the known systems.

Examples of Application

In the following, some examples of application of the just described method are reported for clarity's sake.

A partial deterioration of an isolated joint determines a localized yielding of the rail under load, which causes an anomalous acceleration of the vehicle. In such condition, the geometrical module detects a level defect (gap between rail height and surrounding rolling plane), while the acceleration module detects an anomalous vertical acceleration at the vehicle axles. The visual module, at the same measuring section, recognizes the presence of a joint and detects there is a fracture which reduced its structural stiffness. The concomitance of these three detections (geometrical, accelerometric, visual) allows to verify the defect, thus excluding that it is a false positive.

This redundancy, i.e. the presence of systems measuring many physical aspects, allows a cross check of the defect detection which reduces the error probability, thus allowing a global evaluation of the risk condition, a reduction of false positives, and the determination of the cause determining the defect.

On the basis of the information provided by the system, from the point of view of the maintenance operator, it is clear that the joint is to be repaired or changed, and the correct maintenance operation allows to plan the maintenance operation in a more efficient and economical way, thus avoiding the worsening of the detected condition. In fact, anomalous yielding of the joint leads to high accelerations transmitted from vehicle to track; such accelerations cause ballast yielding, thus further increasing the joint inflection.

If the system detects in the same measuring section absence of crushed stone as well, the maintenance operator will know in advance, i.e. before going physically on place, that in addition to the substitution of the joint, it is to be restored also the ballast original profile.

The further analysis, which can be carried out with the system according to the invention, provided with the information about defects presence, kind, severity and position, is the definition of an index which, in addition to the single defect severity, considers also their mutual position.

It is to be indicated with:

- $d_1, d_2, \ldots, d_3$ a number n of consecutive defects, each one of any different kind, detected by the running railway vehicle;
- $x_{12}, x_{13}, x_{14}, \ldots$, the distance between a defect and the following ones in running direction;
- $h_1, h_2, \ldots, h_n$ the severity index of each defect considered isolated.

It is to be specified that the parameter "d" contains a coding of the defect kind.

The method according to the present invention, in order to carry out an analysis of the synergic action of many isolated defects, provides the calculation of a global severity index $h_t$ of the detected defects, as a function of the kind and severity of each defect, as well as of its relative distance with respect to the other defects.

$$h_t = F(d_i, h_i, x_{ij}) \tag{1}$$

According to a first embodiment, the function F is a linear or not linear combination of the parameters; according to another embodiment the function F is a Fuzzy logarithm or any other mathematical function which allows to combine efficiently the defects synergic effect.

As a way of example, assuming that a defect $d_1$ was detected with severity index $h_1$, and assuming also that a second defect $d_2$ was detected with severity index $h_2$ at distance $x_{12}$ from the first defect, a possible mathematical function calculating the total severity index of the two aggregated defects is the following:

$$h_t = h_1 + \left(e^{-\frac{x_{12}}{a_{12}}}\right) \cdot h_2 \tag{2}$$

The term in parenthesis is a decreasing exponential function which weighs the contribution of defect $d_2$ aggregated to defect $d_1$. If the two defects are present in the same track section, their inter-distance $x_{12}$ is equal to zero, and so the term in parenthesis is equal to 1. Therefore, the effect of defect $d_2$ aggregated to defect $d_1$ is considered completely in the calculation of the combined severity index $h_t$. While the inter-distance increases, the exponential reduces to zero as faster as lower the amplification coefficient $a_{12}$ is. This coefficient quantifies the synergic effect of the distance between two aggregated defects; therefore, it will be higher when the synergic effect of the second defect vanishes rapidly with the distance.

As a way of merely indicative and not limiting example, in the following it is described an embodiment of the method. Let's assume to evaluate the severity index ($h_1$) of a defect according to a scale from 1 to 5, in which:

- value 1 of the index corresponds to a moderate defect which does not require any specific action other than to monitor its evolution in time;
- value 2 corresponds to the need of a maintenance operation in three months;
- value 3 corresponds to the need of a maintenance operation in a week;
- value 4 corresponds to the need of a maintenance operation in a day;
- value 5 corresponds to a very severe defect which requires the suspension of the train circulation and the immediate elimination of the defect.

It is to be considered now the rail gauge measure, whose nominal value is 1435 mm. According to the just described logic, when the system measures in a determined point of the track a rail gauge value equal to 1440 mm it generates a defect with severity index equal to $h_1=1$, since a deviation of 5 mm is not considered severe with respect to the nominal measure. In order to explain better the logic, if in the same point a rail gauge value equal to 1465 mm is measured, the same defect would be assigned a value equal to 4 of the severity index, which would require a maintenance operation in 24 hours.

Let's assume now that at a distance $x_{12}=0{,}5$ m with respect to the point where it was generated the defect with severity index equal to 1, the visual system detects the absence of both bolts on inner and outer couplings of the right rail.

This second defect, taken singularly, is assigned a severity index $h_2=2$, which means a maintenance operation in three months.

However, the close distance between the two defects allows to foresee a possible increase in rail gauge in short time, owing to the absence of two bolts on the right rail, but this defects evolution, even if technically foreseeable, is not signaled by the detection systems known at the state of the art, which consider the defects singularly. Therefore, in case of using one of any system known at the state of the art, maintenance operations would be undertaken in three months, thus allowing the rail gauge defect to evolve towards a condition of greater risk for circulation.

The system according to the present invention instead, by providing the calculation of the total severity index according to what previously explained, even in presence of defects, which are not considered severe singularly, indicates the need of a more imminent maintenance operation.

In fact, by assuming an amplification ratio $a_{12}=2$ for combined presence of a defect kind $d_1$=rail gauge defect and a defect kind $d_2$=absence of couplings, the calculation of the total severity index would be obtained with the yet reported formula (2), which, in this case, would give the following value:

$$h_t = h_1 + \left(e^{-\frac{x_{12}}{a_{12}}}\right) \cdot h_2 = 1 + \left(e^{-\frac{0.5}{2}}\right) \cdot 2 = 2.56 \rightarrow 3$$

The calculated value $h_t$, since it is greater than 2.5, is rounded up to 3, and so, according to the just described severity scale, is it determined the need for a maintenance operation in a week.

Therefore, it is observed as the presence of two close defects which, taken singularly, would indicate the need of a maintenance operation in three months, is detected by the system according to the present invention as a defect which requires a maintenance operation in a week.

In the case of the just explained example, this reduces drastically the evolution of rail gauge defect. However, it is clear that what just described is only an example of the method according to the invention, and that different numerical values can be assigned to amplification factors or to severity indexes, without departing from the aims of the invention.

The invention claimed is:

1. A method of detecting railway equipment defects, the method comprising:

receiving a plurality of detections from at least three diagnostic modules mounted on a railway vehicle, said detections including:

a first detection received from a geometrical module, said first detection indicative of a level defect, which is a gap between rail height and surrounding rolling plain;

a second detection received from an acceleration module, said second detection indicative of anomalous vertical acceleration at the vehicle axles; and a third detection received from a visual module, said third detection indicative of a visual anomaly recognized by the visual module;

determining a position of the railway vehicle associated with each of said plurality of detections;

calculating, for each detection received from each module, a severity index representative of the deviation of the detection relative to a standard condition of a railway track without defects, by:

a) calculating for each detection of each module an initial severity index (hi) indicative of the amplitude of the deviation of the detection relative to the standard condition;

b) associating to each initial severity index (hi) a parameter (di) indicative of the kind of the defect;

c) associating each initial severity index (hi) and respective parameter (di) indicative of the kind of the defect with the position (xi) of the railway vehicle when the detection was received, thereby defining a defect characterized by: a position (xi), a kind parameter (di) and an initial severity index (hi);

d) calculating for each defect defined in point c) a global severity index (ht), as a function of: i) said parameter (di) indicative of the kind; ii) said initial severity index hi); iii) the relative distances (xij) with respect to other detected defects; and iv) the kind parameters and the initial severity indices of said other detected defects; and e) comparing said global severity index (ht) with a threshold to determine if said potential defect needs a maintenance operation or not.

2. The method of detecting railway equipment defects according to claim 1, wherein said global severity index (ht) is given by the sum of:

said initial severity index (hi) and of a contribution relative to each potential defect detected in an area close to said position (xi) of said defect for which the global severity index (ht) is calculated.

3. The method of detecting railway equipment defects according to claim 2, wherein said contribution relative to each potential defect (hj) detected in an area close to said detection position (xi) of said defect for which the global severity index (ht) is calculated is given by the product of the severity index of said potential defect (hj) multiplied by a term which is a function of the relative distance of said two defects (xij) and of said kind parameters of the two defects (di, dj).

4. The method of detecting railway equipment defects according to claim 3, wherein said term which is function of the relative distance of said two defects (xij) and of said kind parameters of the two defects (di, dj) is calculated as negative exponential of the ratio between the distance of the two defects (xij) and an amplification coefficient (aij), function of said kind parameters of the two defects.

5. The method of detecting railway equipment defects according to claim 1, wherein said threshold depends on said kind parameter.

6. The method of detecting railway equipment defects according to claim 1, wherein said first detection is further indicative of at least a parameter selected from the group consisting of rail gauge, superelevation, alignment, longitudinal level, track twist or any other parameter derived from geometrical measures on the rail.

7. The method of detecting railway equipment defects according to claim 1, wherein said visual anomaly detected by said visual module further comprises at least an anomaly selected from the group consisting of absence or anomaly of couplings, joints anomaly, insufficient quantity of crushed stone, absence or loosening of sleeper screws for sleepers and track bolts for joints, presence of fractures on sleepers and rails.

* * * * *